United States Patent [19]

Wang

[11] Patent Number: 4,926,522

[45] Date of Patent: May 22, 1990

[54] UTILITY TOOLS

[76] Inventor: Wei Wang, 3757 16th Ave. S., Minneapolis, Minn. 55407

[21] Appl. No.: 340,135

[22] Filed: Apr. 18, 1989

[51] Int. Cl.[5] ..... B25G 1/04; B25G 3/24

[52] U.S. Cl. ..... 16/114 R; 16/115; 15/143 B; 15/146

[58] Field of Search ..... 16/110 R, 114 R, 115; 15/143 B, 146, 145, 144 B

[56] References Cited

U.S. PATENT DOCUMENTS

| | | | |
|---|---|---|---|
| 195,086 | 9/1877 | Brintzinghoffer | 16/110 R |
| 579,519 | 3/1897 | Loeber et al. | 15/143 B |
| 588,233 | 8/1897 | Moss . | |
| 1,170,835 | 2/1916 | Loy . | |
| 1,256,565 | 2/1918 | Inghram | 15/146 |
| 1,478,124 | 12/1923 | Johnson . | |
| 1,600,148 | 9/1926 | Straub | 15/146 |
| 2,285,383 | 6/1942 | Hertzberg . | |
| 2,407,854 | 9/1946 | Steingard . | |
| 2,572,928 | 10/1951 | Hawes . | |
| 2,804,637 | 9/1957 | Antozak . | |
| 2,820,290 | 1/1958 | Porter, Jr. | 16/115 |
| 2,899,225 | 8/1959 | Birr . | |
| 3,514,139 | 5/1970 | Bromberg . | |
| 3,596,946 | 8/1971 | Burton | 16/115 |
| 3,604,734 | 9/1971 | Friedman et al. . | |
| 3,894,807 | 7/1975 | Betz, III | 16/114 R |
| 3,928,886 | 12/1975 | Marino et al. . | |
| 4,105,346 | 8/1978 | Gelinas | 16/115 |
| 4,285,096 | 8/1981 | Swaim | 16/114 R |
| 4,325,157 | 4/1982 | Baliut et al. | 16/115 |
| 4,524,484 | 6/1985 | Graham . | |
| 4,663,796 | 5/1987 | Helling et al. . | |
| 4,763,377 | 8/1988 | Madsen . | |
| 4,793,646 | 12/1988 | Michaud, Jr. . | |
| 4,796,324 | 1/1989 | Sartori . | |

*Primary Examiner*—Richard K. Seidel
*Assistant Examiner*—Carmine Cuda
*Attorney, Agent, or Firm*—Jacobson & Johnson

[57] ABSTRACT

A utility tool that includes a utility handle for receiving any of a plurality of utility workheads with the utility handle including telescoping sections having twist look sections with one of the ends of the sections having a male thread to attach conventional utility workheads thereto such as brushes and mops and a female thread located coaxial with the male thread to receive an adaptor that permits the attachment of conventional hand held tools that have cylindrical handles or the like and extenders for the utility handle having a male thread on one end and a female thread on the other end to permit the extender to be fastened to the end of the utility handle to permit the telescoping utility handle to be extended further than through normal extension of the telescoping handle.

11 Claims, 3 Drawing Sheets

UTILITY TOOLS

FIELD OF THE INVENTION

This invention relates generally to utility tools and, more specifically, to a tool that can be adapted to handle a number of different and out of reach tasks of a homeowner.

BACKGROUND OF THE INVENTION

The concept of household tools such as mops, brushes, dusters, squeegees or the like is well known in the art. One of the problems homeowners have is that oftentimes a window to be cleaned is out of arms length reach or an area to be dusted can not be reached unless the user stands on a ladder. Frequently, the homeowner will do a number of tasks during the housecleaning operations. For example, the user may want to dust and wash windows. The present invention provides a utility tool comprising a utility handle that is useable with a plurality of utility workheads, the utility handle permits the user to quickly change the workhead on the tool and to extend the utility handle to the proper length so that the user can reach out of the way areas without having to use a ladder. In addition the user can attach a variety of different types of utility workheads to the utility handle to quickly and efficiently complete the work tasks.

DESCRIPTION OF THE PRIOR ART

The 1897 Moss U.S. Pat. No. 588,233 shows a carbon holder for electric lights that uses a thumbscrew to hold carbon rod in a holder.

The 1916 Loy U.S. Pat. No. 1,170,835 shows an awning attachment that uses a thumbscrew to grip a rod.

The 1923 Johnson U.S. Pat. No. 1,478,124 shows a coupling for connecting pump rods that uses threaded female members on both ends of the coupling.

The 1942 Hertzberg U.S. Pat. No. 2,285,383 shows a shaker mop with a moveable head and a handle that rotates as the mop is moved about.

The 1946 Steingard U.S. Pat. No. 2,407,854 shows a carbon holder that uses a thumb screw to hold a rod.

The 1951 Hawes U.S. Pat. No. 2,572,928 shows an extendable trestle that uses twisted elongated members and set screws to permit the user to extend the height of the trestle.

The 1957 Antozak U.S. Pat. No. 2,804,637 shows a sweeping brush that has a pivotable workhead for sweeping walls and floors.

The 1959 Birr U.S. Pat. No. 2,899,225 shows a universal joint for use with a brush head to permit the brush head to be positioned in multiple different positions.

The 1970 Bromberg U.S. Pat. No. 3,514,139 shows a coupling for rods or tubes together that uses a pair of spaced set screws that engage end portions of two different tubes or rods.

The 1971 Friedman U.S. Pat. No. 3,604,734 shows a locking mechanism for frictionally grasping a telescoping member to hold the telescoping member in place.

The 1975 Marino et al. U.S. Pat. No. 3,928,886 shows a paint brush head that can be moved between any of several different locations.

The 1985 Graham U.S. Pat. No. 4,524,484 shows an extension handle that can be extended permit the user to place a longer handle on paint roller, brush or the like.

A rotatable tubular member permits the user to extend and hold the telescoping handle in working position.

The 1987 Helling et al. U.S. Pat. No. 4,633,796 shows a surface working tool with a pivotable head and a releasable disconnect for the workhead.

The 1988 Madsen U.S. Pat. No. 4,763,377 shows a swiveling brush head whereby the resistance to the swiveling of the brush head can be adjusted.

The 1988 Michaud U.S. Pat. No. 4,793,646 shows a telescoping handle that uses spring loaded pins to hold the telescoping sections in place.

The 1989 Sartori U.S. Pat. No. 4,796,324 shows a broom handle that is pivotable with respect to the broom but is only pivotable at an acute angle with respect to the broom head.

SUMMARY OF THE INVENTION

Briefly, the present invention comprises a utility tool having a utility handle having one end that one can quickly attach to a plurality of different types of utility workheads with the utility handle comprising a telescoping, extendable sections that permits a user to quickly extend and lock the sections at the proper length by either telescoping the sections or adding an extender to the utility handle so that the user can use the utility handle with any of a number of utility workheads to perform multiple cleaning activities without the aid of a ladder.

DESCRIPTION OF THE PREFERRED EMBODIMENT

Figure 1:
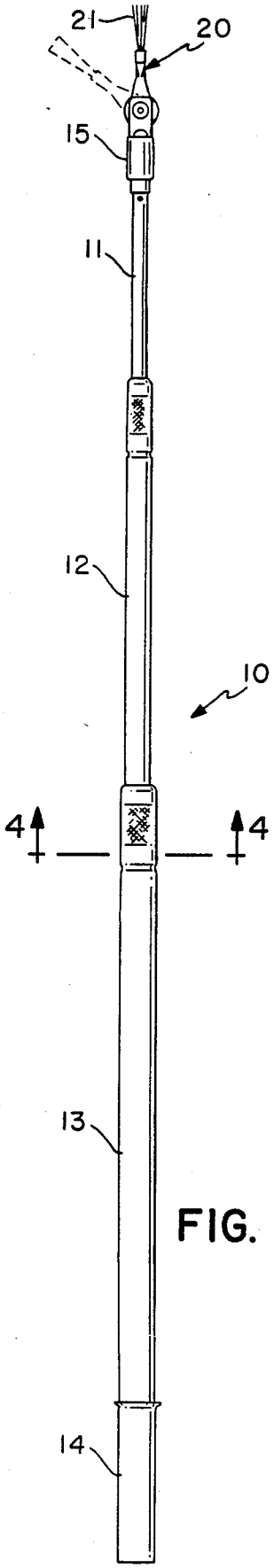
FIG. 1 is a side view of my utility tool with a utility handle having a flat brush broom head pivotally attached to the utility handle.

Referring to FIG. 1 reference numeral 10 identifies my utility tool that comprises an extendable utility handle that includes a first tubular section 11, a second tubular section 12 and a third tubular section 13 that telescope out to the extended position as shown in the drawing. Located on one end of section 13 is a hand grip 14 which is typically made of a polymer plastic or the like. Located on the opposite end on section 11 is a set of course threads 60 that are more clearly illustrated in FIG. 8. Rotatable attached to course threads 60 is one of my utility workheads comprising a pivotable flat broom brush head 20 having an elongated row of bristles 21 extending outward from the base portion of flat broom brush head 20.

Figure 2:
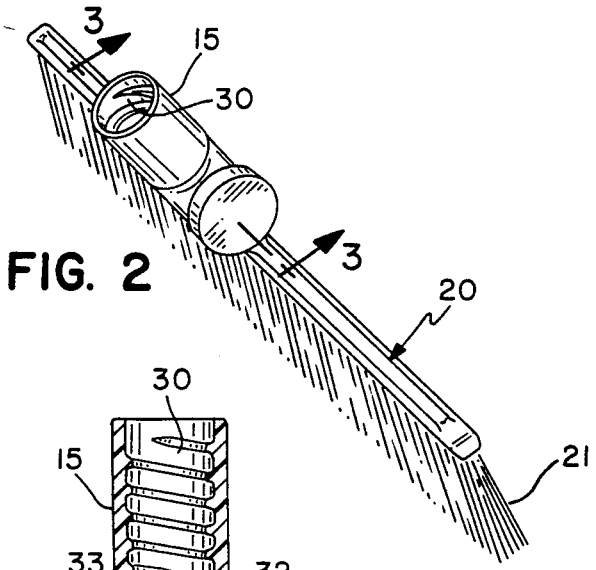
FIG. 2 is pictorial view of the flat brush broom head used with my utility handle.
Figure 3:
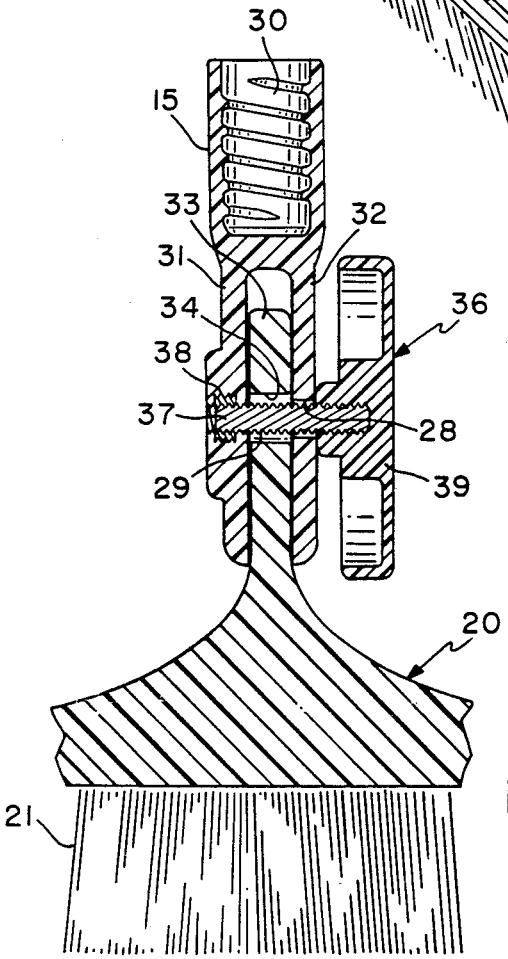
FIG. 3 is a sectional view taken along lines 3—3 of FIG. 2.

FIG. 2 and FIG. 3 show more detail of the utility workhead comprising a flat broom brush head 20 with the broom head having a yoke 15 that includes course female threads 30 for forming rotating engagement with the course threads 60 on the end of extendable utility handle 10. It should be understood that when I refer to course threads I am referring to threads that may have only three or 4 threads to the inch. Such threads are preferred since it only takes a few rotations of the utility handle to quickly secure the utility handle to the utility workhead. Yoke 15 is preferable made of a polymer plastic and includes a pressure lock for holding the broom head 20 in proper position. Yoke 15 includes a first elongated leg 31 and a second spaced apart elongated leg 32 each having parallel surfaces that sandwich around a rectangular shaped extension 33 on broom head 20. Extension 33 is sufficiently narrow so that the user can easily slip extension 33 between the legs 31 and 32 when the stud 37 is not extending through the openings in yoke 15. In operation the user can frictionally lock the broom head in the proper position. The details of the frictional pressure lock system are shown in FIG. 3 and include a rotatable thumb wheel 36 that includes a large head 39 to permit the user to grasp,rotate, and tighten the thumb wheel without the aid of a special tool. Attached to large head 39 is a stud 37 having male threads 29 for engaging a female threaded insert 38 located in leg 31 of yoke 15. Stud bolt 37 rotatable and unengagable extends through an opening 28 in leg 32 and a similar opening 34 in brush head 20. In operation of the yoke 15 the user rotates head 39 to either tighten or loosen brush 20. That is, as the user rotates head in a direction that draws stud 37 into the threaded insert 38 the head 39 forces legs 31 and 32 of yoke 15 to frictionally sandwich extension 33 of brush 20 therebetween. The pivotable and the pressure lock system permit bush head 20 to be adjusted and held in any one of almost 360 degrees of positioning with respect to handle 10. The positionable feature is illustrated in FIG. 1 which shows brush head 20 in phantom to indicate that brush head 20 can be positioned in any of a number of different locations about the end of section 11.

Figure 4:
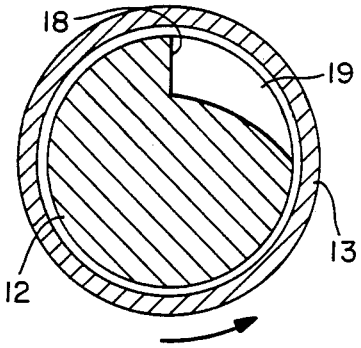
FIG. 4 is cross sectional view of any extendable utility handle in the unlocked position.
Figure 5:
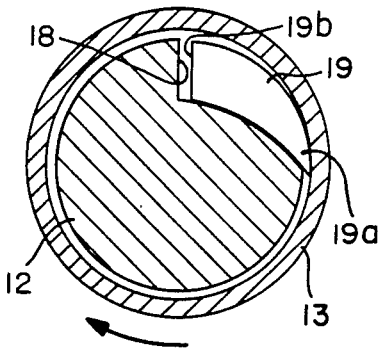
FIG. 5 is a cross sectional view of my extendable utility handle in the locked position.

FIG. 4 and FIG. 5 show the locking mechanism of my telescoping handle that permits the user to lock the handle at a desired length through rotation of adjacent handle sections. FIG. 4 shows outer handle section 13 in cross section with the inner smaller diameter section 12 having a crescent shaped recess 18 with a floating crescent shaped wedge 19 located therein. Floating wedge has a tapered end **19*a* and a blunt end 19*b*. The arrow indicates that if outer section 13 is rotated counterclockwise while the section 12 is held still the floating crescent shaped insert 19 is pulled counterclockwise and does not interfere with the rotation, extension, or collapsing of handle 10. FIG. 5 shows the same sectional view as shown in FIG. 4 except the outer section 13 is rotated clockwise pulling the floating crescent shaped wedge 19 into jamming and locking engagment between section 13 and section 12. That is, as section 13 is rotated in the clockwise direction it pulls the tapered end 19*a* of floating wedge 19 into frictional locking engagement between section 13 and section 12 thus locking the adjacent handle sections 12 and 13 into a rigid section. A slight counterclockwise twist of section 13 frees crescent shaped floating wedge 19 from engagement with sections 12 and 13 thus permitting utility handle sections 12 and 13 to be moved relative to one another. Although not shown a similar locking arrangement exist between handle section 11 and 12. In the preferred embodiment the crescent shaped floating wedge is made from a polymer plastic such as nylon or the like. Floating wedge 19 should have a tapered end 19*a* for interfering with the rotation of adjacent sections and an opposite end 19*b* that is sufficiently wide that it cannot be pulled into the slight circumferential gap between the outside of section 12 and the inside of section 13**.

Figure 6:
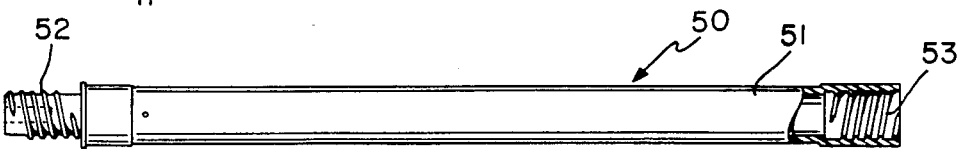
FIG. 6 shows an extender for extending my utility handle to reach places that are normally out of reach of conventional telescoping handles.

FIG. 6 shows an extender that permits the user to extend the telescoping utility handle to lengths normally not obtainable with a conventional telescoping utility handle. That is, the use of end to end telescoping sections requires that each one of the sections have a smaller diameter than its adjacent section so that the sections can telescope in one another. In certain instances the extension of the handle with telescoping would render the utility handle diameter sufficiently flexible so that it would become ineffective in performing the cleaning function. To eliminate this problem I provide an extender 50 that mates on to the course threads 60 on the end of utility work handle section 11. Extender 50 comprises a tubular section with a set of course male threads 52 on one end and a set of course female threads 53 on the opposite end. Female threads 53 mate with male threads 60 to permit the user to quickly attach extender 50 to the end of section 11 by merely threading section 11 and 50 together in an end to end relationship. Located on the opposite end of extender 50 is a set of course male threads 52 that are identical to the course male threads 60 on the end of tubular section 11. Thus the addition of extender 50 or any number of extenders 50 to the end of tubular section 11 permits the user to attach any of a number of different utility workheads to my extendable utility handle.

Figure 8:
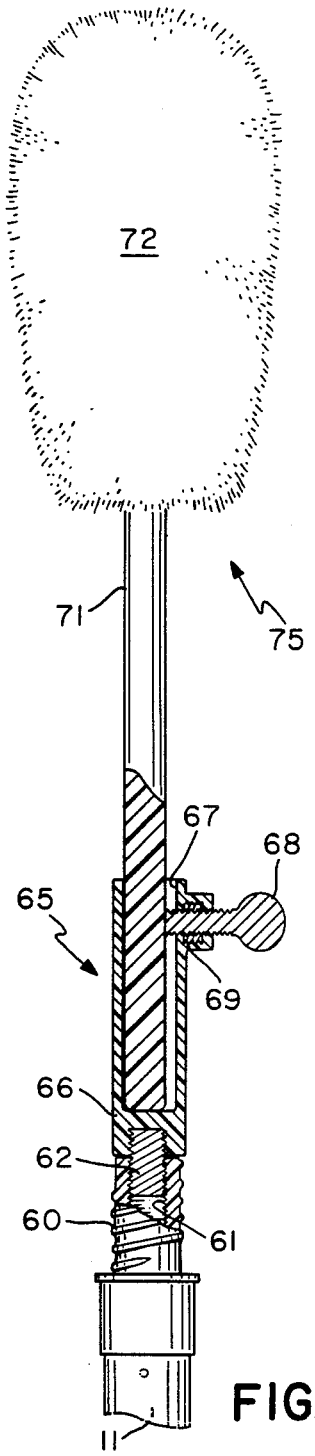
FIG. 8 shows a partial cross sectional view of the adaptor supporting a duster at the end of the telescoping utility handle.
Figure 7:
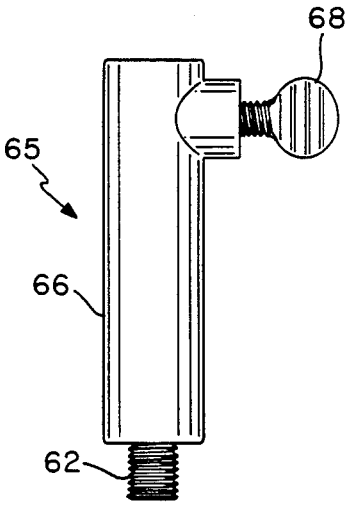
FIG. 7 shows an adaptor that permits the telescoping utility handle to be used with a variety of different workheads.

FIG. 7 and 8 show my adapter 65 that enables the user to attach different types of utility workheads to my utility handle. Adaptor 65 has a cylindrical housing 66 with a male threaded stud insert 62 that is secured to and extends from one end of adaptor 65. Located on the opposite end of adaptor 65 is a thumb screw 68 that has a threaded section that extendes at right angles through cylindrical housing 66 to permit a user to lock an article in the cylindrical chamber 67 located in the interior of adaptor 65. FIG. 8 reveals another feature of my utility handle that makes is compatible with my adaptor 65 or a variety of different utility workheads. Located in the end of section 11 is a central opening that is coaxial with section 11. Opening 61 includes female threads 61 that form threaded engagement with threaded stud insert 62 on adaptor 65. The coaction of the threads on adaptor 65 and utility handle section 11 permit one to quickly convert my extendable utility handle from a handle for holding screw on utility workheads such as brooms, brushes or the like to a device that can hold non screw in items such as dusters or the like which have straight cylindrical handles that are normally designed to be held in the user hands.

The hand duster 75 shown in FIG. 8 comprises a conventional feathery, soft, flexible, dust head 72 and a straight cylindrical rod 72 that is normally held in the user's hand but is now positioned in chamber 67 in adaptor 65. In order for the user to securely hold rod 71 in position I provide a thumb screw 68 that rotates in a threaded insert 69 in adaptor 65. In order to provide secure grip and for extended life I prefer to place a metal female threaded insert 69 in my adaptor 65 which I prefer to make of a material such as polymer plastic. One of the purposes of using an adaptor that fits into a threaded insert in the end of section 11 is that I can provide an enlarged chamber 67 to receive large diameter rods on other devices without weakening the end of section 11. That is, adaptor 65 can be made with a large diameter cylindrical chamber to provide a large chamber for receiving the thicker handles of conventional hand held cleaning tools such as dusters or the like.

Figure 11:
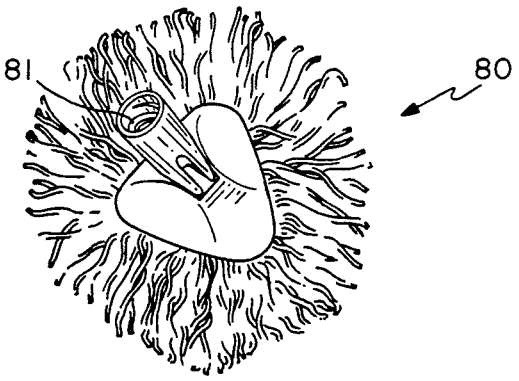
FIG. 11 shows a top view of a mop head for use with my telescoping utility handle.
Figure 10:
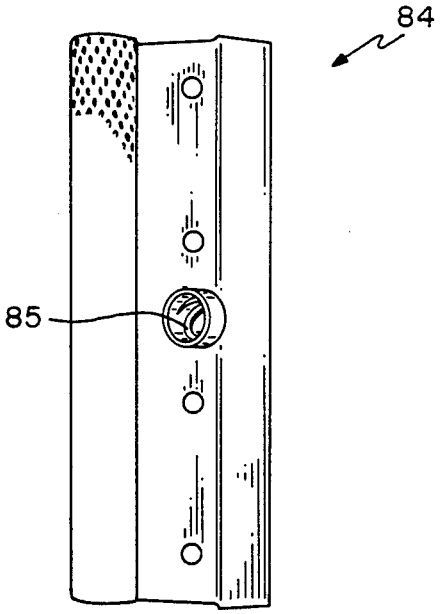
FIG. 10 shows a top view of a squeegee for use with my telescoping utility handle.
Figure 9:
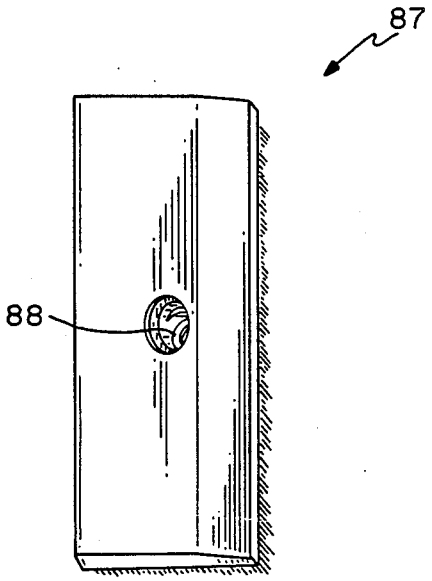
FIG. 9 shows a top view of a flat scrub brush for use with my telescoping utility handle.

To illustrate the versatility of my invention with different utility workheads I have shown multiple utility workheads in FIGS. 9, 10, and 11 that can be attached directly to the course male threads 60 on section 11. FIG. 9 shows a scrub brush head 87 having a course female thread 88 for permitting the user to attach scrub brush 87 to utility handle section 11. Similarly, FIG. 10 shows a squeegee head 84 having a course female thread 85 to permit the attachment of the squeegee head to handle 11. FIG. 11 shows a conventional mop head 80 having a course female thread 81 to permit mop head 80 to be attached to the end section 11 of my utility handle.

I claim:

1. A utility tool having a utility handle for use with a plurality of utility workheads comprising:

an extendable utility handle, said extendable utility handle having a first tubular section with a first end having a male threaded section and a female threaded section for engaging with attachments and a second end with a floating wedge located therein, a second tubular handle section located in rotational position on the outside of said first tubular section to permit the user to rotate said second tubular handle section to thereby lock said first tubular section against said second tubular section through the frictional engagement of said floating wedge between said first tubular section and said second tubular section to thereby hold said first tubular section and said second tubular section in locking engagement with each other;

an extender for attaching to one end of said first tubular section, said extender having a female thread on one end for engaging the first end of said tubular section and a male thread on the opposite end to permit said extender to be connected to various utility workheads, said extender including a female thread on said opposite end to connect to an adaptor; and an adaptor, said adaptor having a stud to permit the engagement of said adaptor with said female thread of said first tubular section or an extender attached to said first tubular section, said adaptor including a cylindrical chamber for receiving a conventional handle of a utility tool and a thumbscrew for fastening the handle of a utility tool in said cylindrical chamber of said adaptor to thereby permit the user to use a utility workhead lacking male or female threads in places where the user can not normally reach.

2. The utility tool of claim 1 including a utility workhead comprising an elongated broom brush head, said elongated broom brush head having a yoke member, said yoke member having a first end for forming threaded engagement with said first section, said yoke member including a pair of parallel extending spaced apart legs for sandwiching around a flat member, said broom brush head having a flat extension that slides between said legs of said yoke, said flat extension positioned with respect to said elongated broom brush head so that said elongated broom brush head projects substantially perpendicular in either direction from said parallel extending spaced apart legs, said broom brush head including a pressure lock mechanism that permits the user to tightly sandwich said extension between said legs of said yoke so that said extension holds said broom brush head in a work position on the end of said utility handle.

3. The utility tool of claim 1 wherein said chamber can receive the handle of a conventional hand held tool.

4. The utility tool of claim 1 wherein said thumbscrew penetrates said adaptor to permit the user to fasten the handle of a handheld utility workhead in said adaptor to permit the user to use said handheld utility workhead with said utility handle.

5. The utility tool of claim wherein said utility handle includes at least three tubular telescoping sections.

6. The utility tool of claim 1 wherein said first section includes a female thread located coaxial with said male thread to permit a user to coaxially attach said adaptor to said first section.

7. The utility tool of claim 1 wherein said floating wedge has a first tapered end for forming frictional locking between said first section and said second section when said first section is rotated in a first direction to thereby convert said first section and said second section to a locked and extended relationship.

8. The utility tool of claim 7 wherein said floating wedge has a nontapered end opposite the tapered end with said nontapered end sufficiently large to prevent forming wedging action between said first section and said second section.

9. The utility tool of claim 8 including a flat elongated broom brush head that is pivotable almost 360 degrees to permit the user to position the elongated flat broom brush head at the proper angle for cleaning.

10. The utility tool of claim 1 wherein said utility tool includes a utility workhead comprising a dust head.

11. A utility tool for use with utility workheads having screwing attachment chambers and for utility workheads that are conventional held in the hand of the user comprising:

a utility handle, said utility handle including a first tubular section and a second tubular section located in telescoping arrangement with one another to permit a user to lengthen or shorten the tubular sections with respect to one another to thereby permit the user to lengthen or shorten said utility handle;

an extender for attaching to one end of said first tubular section, said extender having a female thread on one end for engaging the first end of said tubular section and a male thread on the opposite end to permit said extender to be connected to various utility workheads, said extender including a female thread on said opposite end to connect to an adaptor; and an adaptor, said adaptor having means for engaging said first tubular section and a housing having a chamber for receiving and holding a utility workhead that is normally held in a users hand, said means including a cylindrical chamber having a thumbscrew with one end extending partially across said cylindrical chamber to engage the utility workhead that is normally held in the users hand by tightly sandwiching the utility workhead in the chamber between the end of said thumb-screw and a portion of said cylindrical chamber so that said utility workhead is firmly held in said cylindrical chamber.

* * * * *